US006880315B2

(12) United States Patent
Burdorff

(10) Patent No.: US 6,880,315 B2
(45) Date of Patent: Apr. 19, 2005

(54) APPARATUS FOR FORMING A BAIT SACK

(76) Inventor: Stewart C. Burdorff, 7835 Brak men Rd., Leroy, OH (US) 44077

( * ) Notice: Subject to any disclaimer, the term of this patent is extended or adjusted under 35 U.S.C. 154(b) by 0 days.

(21) Appl. No.: 10/717,683

(22) Filed: Nov. 20, 2003

(65) Prior Publication Data

US 2004/0098952 A1 May 27, 2004

Related U.S. Application Data

(60) Provisional application No. 60/428,098, filed on Nov. 21, 2002.

(51) Int. Cl.[7] ..... B65B 9/06

(52) U.S. Cl. ..... 53/575; 53/574; 53/576; 53/577; 53/138.6; 53/390; 43/4; 43/55

(58) Field of Search ..... 53/575, 576, 574, 53/577, 390, 260, 138.6; 43/4, 55

(56) References Cited

U.S. PATENT DOCUMENTS

| | | | | | |
|---|---|---|---|---|---|
| 1,497,276 | A | * | 6/1924 | Hirschhorn | 426/394 |
| 1,592,308 | A | * | 7/1926 | McCullough | 53/260 |
| 1,894,346 | A | * | 1/1933 | Cooper | 53/456 |
| 2,118,551 | A | * | 5/1938 | Doble | 426/81 |
| 2,148,587 | A | * | 2/1939 | Slocum | 53/413 |
| 3,175,338 | A | | 3/1965 | Ahlgren et al. | |
| 3,550,353 | A | | 12/1970 | Haadsma | |
| 3,696,585 | A | | 10/1972 | Ritter | |
| 3,976,413 | A | * | 8/1976 | Popeil | 425/117 |
| 4,047,320 | A | * | 9/1977 | Lee | 43/55 |
| 4,555,893 | A | | 12/1985 | Nakata et al. | |
| 4,669,252 | A | * | 6/1987 | Steinhilber | 53/390 |
| 4,944,133 | A | | 7/1990 | Mause | |
| 5,155,930 | A | * | 10/1992 | Monarez | 43/4 |
| 5,473,858 | A | * | 12/1995 | Hayes | 53/414 |
| 5,737,903 | A | * | 4/1998 | Minutillo | 53/475 |
| 5,899,049 | A | * | 5/1999 | Fuss et al. | 53/459 |
| 6,625,920 | B1 | * | 9/2003 | Rockwell | 43/4 |
| 2004/0009378 | A1 | * | 5/2004 | Brahm et al. | |

* cited by examiner

*Primary Examiner*—Scott A. Smith
*Assistant Examiner*—Gloria R. Weeks
(74) *Attorney, Agent, or Firm*—Tarolli, Sundheim, Covell & Tummino L.L.P.

(57) ABSTRACT

An apparatus for forming a bait sack using a netting material comprises a filling collar having a tubular configuration and an inside surface for directing bait into the netting material. A forming sleeve has a tubular configuration and is disposed coaxially about the filling collar. A netting material is disposed between the filling collar and the forming sleeve. The filling collar and the forming sleeve are movable relative to each other to form a bait sack with the netting material.

3 Claims, 1 Drawing Sheet

APPARATUS FOR FORMING A BAIT SACK

RELATED APPLICATION

The present application claims priority from U.S. provisional patent application Ser. No. 60/428,098, filed Nov. 21, 2002, the disclosure of which is incorporated herein by reference.

FIELD OF THE INVENTION

The invention is directed to an apparatus for forming a bait sack into which bait is placed and which is then tied to form the bait sack.

BACKGROUND OF THE INVENTION

Bait sacks filled with salmon eggs or roe are commonly used in fishing for steelhead, trout, salmon, and other species of fish. The bait sacks are typically made out of nylon mesh and are formed by hand. This process can be quite messy and time-consuming, and is not easily done in the field.

A primary objective of this apparatus is to allow for both home use and field use to form bait sacks.

Another objective of this apparatus is to be lightweight, compact, portable, and easy to operate.

Another objective of this apparatus is to eliminate human contact with the bait form, such as salmon eggs or roe, during the forming and tying, which results in a better bait sack.

SUMMARY OF THE INVENTION

The present invention is an apparatus for forming a bait sack using a netting material. The apparatus comprises a filling collar having a tubular configuration and an inside surface for directing bait into the netting material. A forming sleeve has a tubular configuration and is disposed coaxially about the filling collar. A netting material is disposed between the filling collar and the forming sleeve. The filling collar and the forming sleeve are movable relative to each other to form a bait sack with the netting material.

One feature of the apparatus is its cylindrical design and coaxial operation in which the components function to form and fill the formed sack until the bait sack is tied.

Another feature of the apparatus is a self-contained chamber in which the tying material, such as thread or a similar material, is housed.

Another feature of the apparatus is that it allows the components to be interlocked to form a one-piece assembly.

Another feature of the apparatus is the use of O-rings in the forming of the netting and the holding of the netting during the tying process.

The tool is comprised of aluminum construction in cylindrical forms. The unit is made up of a handle body, a forming sleeve, a filling collar, an enclosing cap, and two O-rings.

The apparatus creates a balloon-shape form by means of the cylindrical forming sleeve and the filling collar. The forming sleeve utilizes an O-ring which allows the forming sleeve to slip over a nylon (or similar) material located between the filling collar and the forming sleeve. Retraction of the forming sleeve to the end of the filling collar allows the O-ring to grip and form the nylon mesh into a balloon-shaped form. Bait can then be deposited into an oppositely disposed, open end of the filling collar. The handle body is then placed into the filling collar to entrap the bait while the form is tied. The handle body includes a self-contained chamber which houses a tying material. The enclosing cap screws onto a hollow, open end of the handle body to enclose thread, or a thread-like material, in the chamber.

BRIEF DESCRIPTION OF THE DRAWINGS

The foregoing and other features of the present invention will become apparent to those skilled in the art to which the present invention relates upon reading the following description with reference to the accompanying drawings, in which.

DESCRIPTION OF A PREFERRED EMBODIMENT

The invention is directed to an apparatus for forming a bait sack into which bait is placed and which is then tied to form the bait sack.

Figure 2:
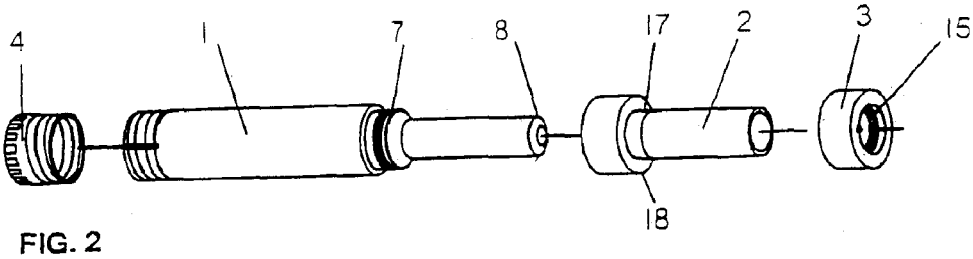
FIG. 2 is an exploded perspective view of the apparatus of FIG. 1 with the netting omitted for clarity.

The apparatus includes a handle body 1, filling collar 2, forming sleeve 3, enclosing cap 4, and two O-rings 7 and 15, as shown in FIG. 2. The handle body 1, filling collar 2, forming sleeve 3, and enclosing cap 4 are all cylindrical components that are formed out of an aluminum material that has been anodized to give surface protection. The O-rings 7 and 15 are of buna-nitrile construction.

Figure 1:
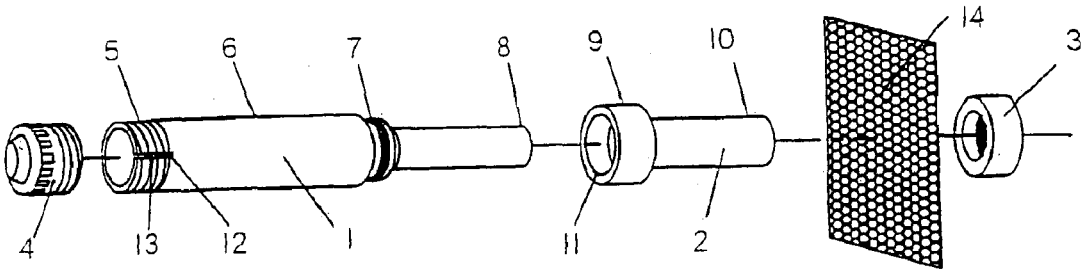
FIG. 1 is an exploded perspective view of the cylindrical components used in the apparatus according to the invention and shows positional relationship of the netting prior to assembly of the components and forming of a bait sack.
Figure 3:
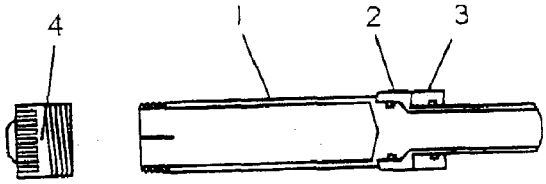
FIG. 3 is a cross-sectional view of the cylindrical components in an assembled condition.

The handle body 1 includes a hollow chamber 13 in cylindrical form for containing and enclosing a tying material 20 (FIG. 6), which is typically thread in spool form. The handle body 1 includes a locking O-ring 7, which in the use or storage state of the apparatus, locks the handle body 1 into an inside surface 11 of the filling collar 2, as shown in FIGS. 1 and 3. A piston end 8 of the handle body 1, when placed into the filling collar 2 in the above stated locked position, entraps the bait during the tying process. The handle body 1 also includes an external thread 5 to accept a mating internal thread on the enclosing cap 4, which keeps the tying material 20 clean and free from dirt in the hollow chamber 13. The handle body 1 contains a thread feed slot 12, which allows the tying material 20 to be pulled from the hollow chamber 13 when the enclosing cap 4 is attached to the handle body 1 during use.

The filling collar 2 is a hollow body in cylindrical form used in the forming of netting 14 over a polished outer surface 10. The inside surface 11 of the filling collar 2 is used for placing bait into the netting form during use. The outside surface 9 of filling collar 2 is used for handling during placement of the bait and also for locking onto the handle body 1.

The forming sleeve 3, as shown in FIG. 2, houses an O-ring 15 on the inside diameter which allows the sleeve to slip freely over the filling collar 2. The forming sleeve 3 can be reversed to allow the O-ring 15 to lock onto the filling collar 2 via a locking diameter 17 when in a non-use state.

The cap 4 includes internal threads, as mentioned previously, for attaching to the handle body 1.

Figure 4:
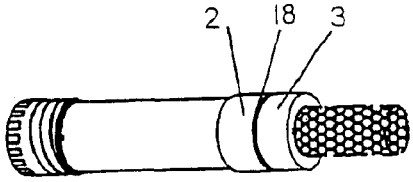
FIG. 4 is a perspective view similar to FIG. 2 but shows the apparatus in an assembled condition during the initial stage of forming a bait sack.

The function of the apparatus is described below. The netting material 14, shown in FIG. 1 is usually of square sheet form and made out of a nylon-type material. The netting material 14 is centered over the forming sleeve 3, as shown in FIG. 1. This can be done by placing the forming sleeve 3 on a flat surface or in the palm of your hand and then placing the netting 14 centered over the forming sleeve. Next, the filling collar 2 is slipped axially into the netting 14 and through the forming sleeve 3, causing the forming sleeve to slide up to the shoulder 18 of the filling collar 2 as shown in FIG. 4. The distance the forming sleeve 3 travels up to the shoulder 18 is a means of controlling the form size of the bait sack, thus giving the user the ability to control to form large or small bait sacks.

Figure 5:
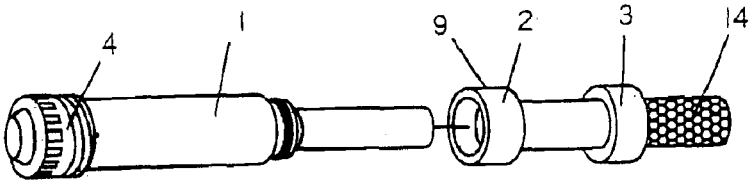
FIG. 5 is a perspective view similar to FIG. 1 but showing the apparatus in an assembled condition and prior to filling of the bait sack with bait.

Next, the forming sleeve 3 is retracted without removing it back flush to the end of the filling collar 2. The filling collar 2 is removed by pulling the shoulder 9 from the handle body 1 as shown in FIG. 5. By holding the filling collar 2 in an upright vertical position using a spoon or other bait dispenser (not shown), bait (shown schematically at 22 in FIG. 6) can then be placed into the open end 11 of the filling collar 2 so that the bait sets down into the netting 14. Next, holding the shoulder 9 of the filling collar 2, the handle body 1 is pushed axially into the open end 11 (FIG. 1) of the filling collar 2 in the locking position to entrap the bait 22 in the formed netting 14 as represented in FIG. 6.

Figure 6:
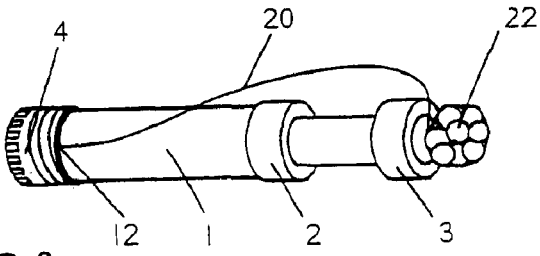
FIG. 6 is a perspective view showing the bait as tied into the netting form along with the tying material feature of the apparatus.

The tying material 20, which is housed in the enclosed chamber 13 of the handle body 1, can then be pulled from the thread feed slot 12, as shown in FIG. 6. The tying material 20 is drawn out to a desired length and cut using a known cutting means (not shown). Alternatively, the tying material 20 can be drawn to the end of the apparatus for tying as shown in FIG. 6. Holding the handle body 1 in one hand and placing the thumb of the hand over the tying material 20 at the outside diameter of the forming sleeve 3, the tying material can be wrapped around the bait sack form and tied off with the other hand also represented in FIG. 6. The forming sleeve 3 can then be removed from the end of the apparatus in which any excess netting material 14 or tying material 20 can be trimmed off.

It should be understood that the apparatus disclosed herein could be used to form bait sacks that are filled with a variety of different types of bait used to catch various types of both freshwater and saltwater fish.

From the above description of the invention, those skilled in the art will perceive improvements, changes and modifications. Such improvements, changes and modifications within the skill of the art are intended to be covered by the appended claims.

Having described the invention, I claim:

1. An apparatus for forming a bait sack using a netting material, said apparatus comprising:

a filling collar having a tubular configuration and an inside surface for directing bait into the netting material;

a forming sleeve having a tubular configuration and being disposed coaxially about the filling collar;

a netting material disposed between the filling collar and the forming sleeve;

the filling collar and the forming sleeve being movable relative to each other to form a bait sack with the netting material; and a handle body having a cylindrical configuration, the handle body including a first end for sliding into the filling collar to temporarily enclose bait in the bait sack.

2. The apparatus of claim 1 wherein the handle body has a second end that includes a chamber for holding a tying material for permanently enclosing the bait in the bait sack.

3. An apparatus for forming a bait sack using a netting material, said apparatus comprising:

a filling collar having a tubular configuration and an inside surface for directing bait into the netting material;

a forming sleeve having a tubular configuration and being disposed coaxially about the filling collar;

a netting material disposed between the filling collar and the forming sleeve;

the filling collar and the forming sleeve being movable relative to each other to form a bait sack with the netting material; and the forming sleeve including an O-ring that grips the netting material and forms the netting material into a bait sack.

* * * * *